US006520802B1

(12) United States Patent
Mitra

(10) Patent No.: US 6,520,802 B1
(45) Date of Patent: Feb. 18, 2003

(54) SHIELDED CONNECTOR ASSEMBLY

(75) Inventor: Niranjan Kumar Mitra, Eindhoven (NL)

(73) Assignee: FCI, Paris Cedex (FR)

( * ) Notice: Subject to any disclaimer, the term of this patent is extended or adjusted under 35 U.S.C. 154(b) by 0 days.

(21) Appl. No.: 10/018,710

(22) PCT Filed: Jun. 16, 2000

(86) PCT No.: PCT/NL00/00421

§ 371 (c)(1),
(2), (4) Date: Dec. 14, 2001

(87) PCT Pub. No.: WO01/01524

PCT Pub. Date: Jan. 4, 2001

(30) Foreign Application Priority Data

Jun. 16, 1999 (NL) ..... 1012357
Jun. 16, 1999 (NL) ..... 1012358

(51) Int. Cl.[7] ..... H01R 13/648
(52) U.S. Cl. ..... 439/608; 439/541.5; 439/79
(58) Field of Search ..... 439/607, 609, 439/65, 79, 101, 108, 660, 354, 541.5

(56) References Cited

U.S. PATENT DOCUMENTS 2,183,067 A 12/1939 Gardner et al. ..... 173/361
4,734,060 A 3/1988 Kawawada et al. ..... 439/660
5,228,864 A * 7/1993 Fusselman et al. ..... 439/108
5,277,624 A 1/1994 Champion et al. ..... 439/607
5,551,896 A * 9/1996 Hess et al. ..... 439/701
5,688,130 A * 11/1997 Huang ..... 439/79
5,816,831 A * 10/1998 Clark ..... 439/79
5,934,939 A * 8/1999 Thenaisie et al. ..... 439/607
6,115,257 A * 9/2000 Laity ..... 439/737
6,299,455 B1 * 10/2001 Dong ..... 439/59
6,179,651 B1 * 1/2002 Huang ..... 439/541.5
6,179,652 B1 * 1/2002 Tung et al. ..... 439/541.5
6,350,152 B1 * 2/2002 Belopolsky et al. ..... 439/541.5
6,416,360 B1 * 7/2002 Zhang et al. ..... 439/607
6,443,768 B1 * 9/2002 Dirkers ..... 439/607

FOREIGN PATENT DOCUMENTS

| | | |
|---|---|---|
| DE | 29613738 U1 | 10/1996 |
| EP | 0563942 A2 | 10/1993 |
| EP | 0634817 A2 | 1/1995 |
| EP | 0852414 A2 | 7/1998 |
| EP | 0854549 A2 | 7/1998 |
| WO | WO 00/77887 A1 | 12/2000 |

* cited by examiner

*Primary Examiner*—Tho D. Ta
*Assistant Examiner*—Larisa Tsukerman
(74) *Attorney, Agent, or Firm*—Perman & Green, LLP

(57) ABSTRACT

A female connector (1) with a shielding plate (2) has contact elements (4) on printed circuit boards (7) arranged in rows and columns in a housing (3) comprising two modules (6) stacked in a column direction. The second surface of the PCB has a conducting ground plane connected to a pattern of ground tracks on the other surface, while the PCBs of one module are connected through an intermediate insulating section (19). The rows of contact elements receive the male contact elements when the male connector is inserted into the receiving space of the female connector.

10 Claims, 6 Drawing Sheets

SHIELDED CONNECTOR ASSEMBLY

This application claims the benefit of the earlier filed International Application No. PCT/NL00/00421, International Filing Date, Jun. 16, 2000, which designated the United States of America, and which international application was published under PCT Article 21(2) in English as WO Publication No. WO 01/01524 A2.

The invention relates to a connector assembly, comprising female and male connectors, each connector comprising a housing and a plurality of contact elements mounted in the housing, said contact elements being arranged in rows and columns, wherein the housing is provided with rows of slots receiving first sections of the contact elements, the housing of the female connector having at least one receiving space for receiving a part of the housing of the male connector, wherein a row of contact elements is located at both sides of the receiving space of the female connector housing and a row of contact elements is located at both sides of the part of the male connector housing to be inserted into the receiving space, the contact elements of the male connector contacting the contact elements of the female connector when the male and female connectors are mated.

Connectors of this type are known in various embodiments, see for example US-A-4 734 060. In the connector disclosed in US-A-4 734 060 the housing of both connectors is a single moulded part wherein only two rows of contact elements are provided. Generally, the number of contact elements in row and column directions depends on the application of the connectors and a range of connectors with different numbers of contact elements in row and column directions should be available. The design of the known connector imposes limitations regarding miniaturization and manufacturing flexibility. In particular regarding miniaturization and increasing signal speed, it is important to provide an efficient shielding of the signal contact elements while maintaining a high signal density on the surface area needed for the connector.

EP-A-0 563 942 shows a connector assembly according to the preamble of claim 1. In this known connector assembly, the female connector comprises a one part housing of insulating material having two receiving spaces, wherein a metal shielding is inserted into an internal partition of the housing as a shielding between the pair of rows of contact elements of each receiving space. The male connector comprises a housing of insulating material, wherein a metal shielding is embedded in an internal petition of the housing.

The invention aims to provide a connector assembly of the above-mentioned type with an efficient shielding and high manufacturing flexibility.

To this end the connector assembly of the invention is characterized in that the female connector housing comprises a housing part for each row of contact elements, each housing part including an elongated mainly rectangular flat printed circuit board supporting the corresponding row of contact elements on a first surface and having a conductive ground plane on an opposite second surface, wherein a housing section of insulating material is mounted on said first surface, said housing section having one of said rows of slots, wherein the female connector housing comprises at least one module, each module having two interconnected printed circuit boards having their first surfaces directed towards each other and determining one receiving space, and in that the male connector housing comprises at least one housing part adapted to be inserted into the receiving space of a module during mating of the male and female connectors and provided with two rows of contact elements, each housing. part including an elongated mainly rectangular flat metal plate with an overmoulded layer of insulating material at both sides, each insulating layer having one of said rows of slots with contact elements.

In this manner a connector assembly is obtained wherein when the male and female connectors are mated, the ground planes of the printed circuit boards of the female connector and the metal plate(s) of the male connector provide a very efficient shielding between successive rows of interconnected contact elements. Moreover, the number of contact elements in column direction can be easily adapted by adding further modules to the male and female connectors. Thereby, the connector assembly design of the invention allows to provide any number of rows without tooling-up new housing moulds, resulting in a flexible and low cost manufacturing.

The invention will be further explained by reference to the drawings in which an embodiment of the connector assembly of the invention is shown.

FIG. 1 shows a perspective view of an embodiment of the connector according to the invention with an outer shielding plate shown separately.

FIG. 2 schematically shows a cross section of the connector according to FIG. 1.

FIG. 3 schematically shows an exploded view in cross section of the printed circuit boards of the connector of FIG. 1.

The female and male connectors described in the present application are of the type described in Dutch patent applications 1012345 and 1012361-1012367 of the same applicant. In the present application the features distinguishing the present connectors from the connectors described in these applications are described in detail. For further details regarding the construction of the connectors and the components of the same reference is made to these applications which are deemed to be incorporated by reference.

Figure 2:
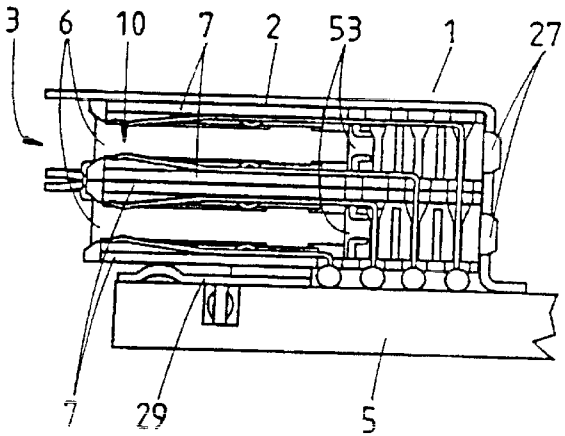
Figure 1:
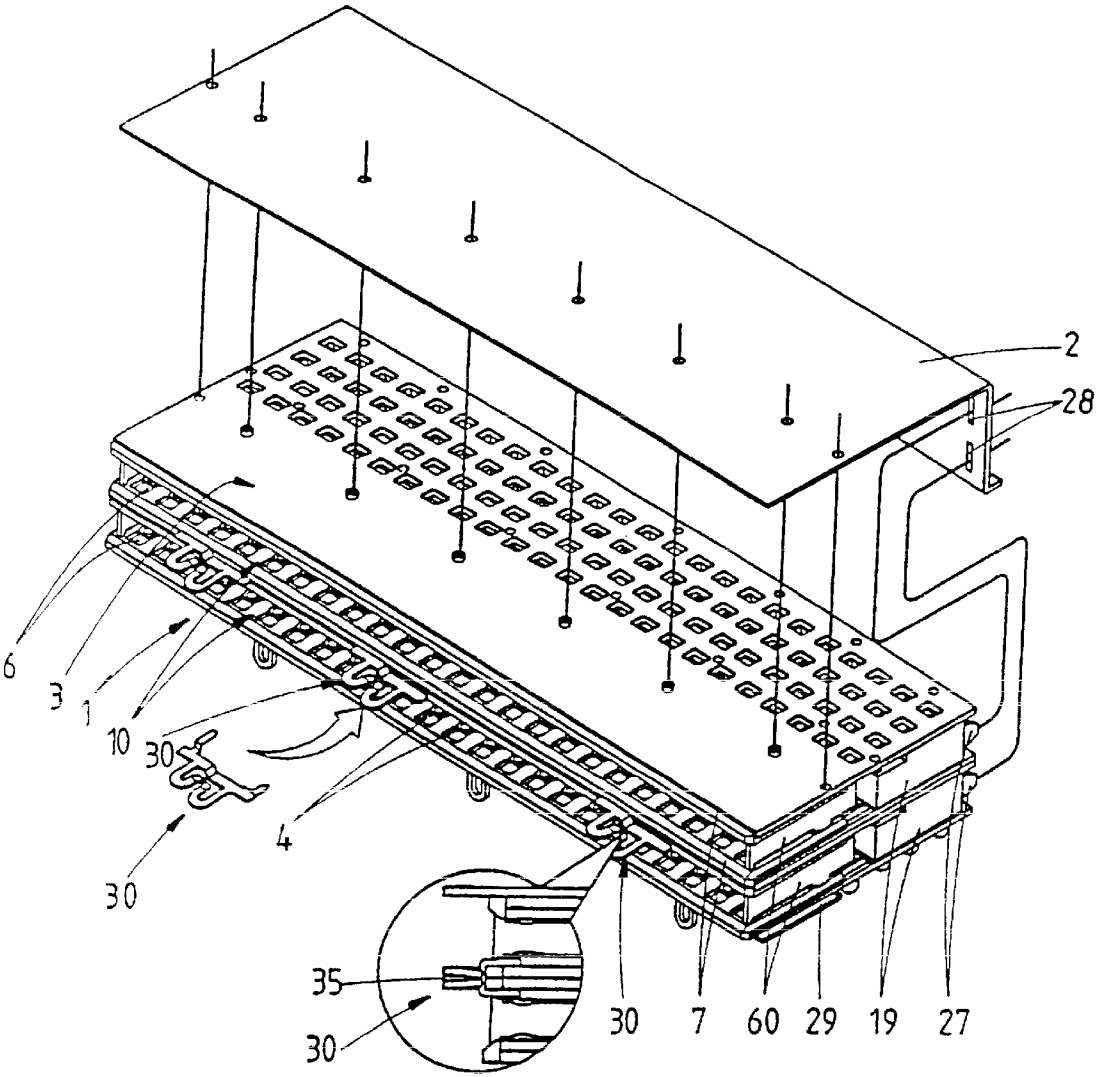

Referring to FIGS. 1 and 2, there is shown a female connector 1 comprising an outer shielding plate 2 and a housing 3 with a plurality of female contact elements 4 arranged in rows and columns. As can been seen in the cross section of FIG. 2, the female connector 1 is a so-called right-angled connector and can be mounted on a printed circuit board 5. The outer shielding plate 2 covers the upper and back sides of the housing 3.

Figure 3:
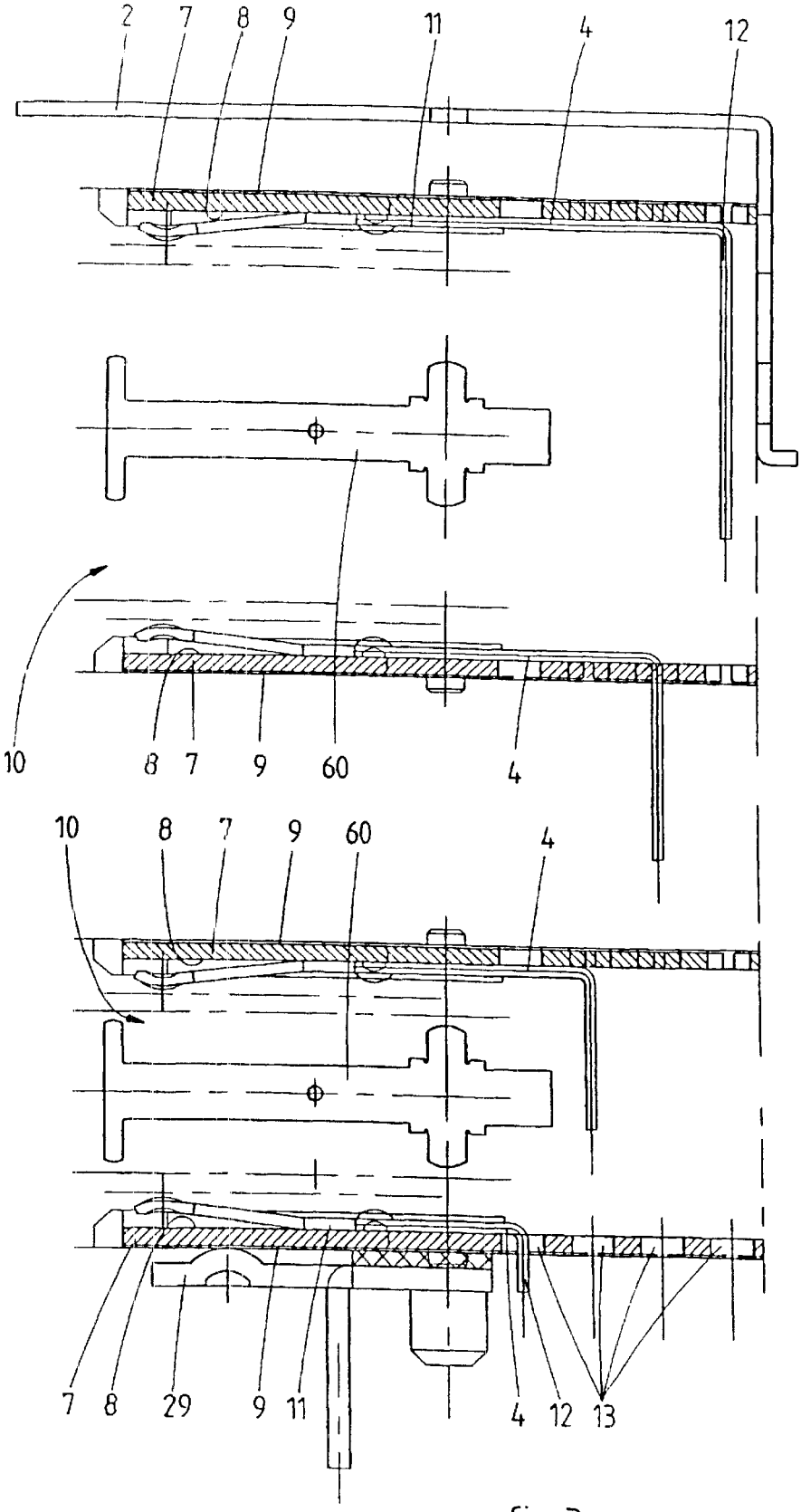
Figure 4:
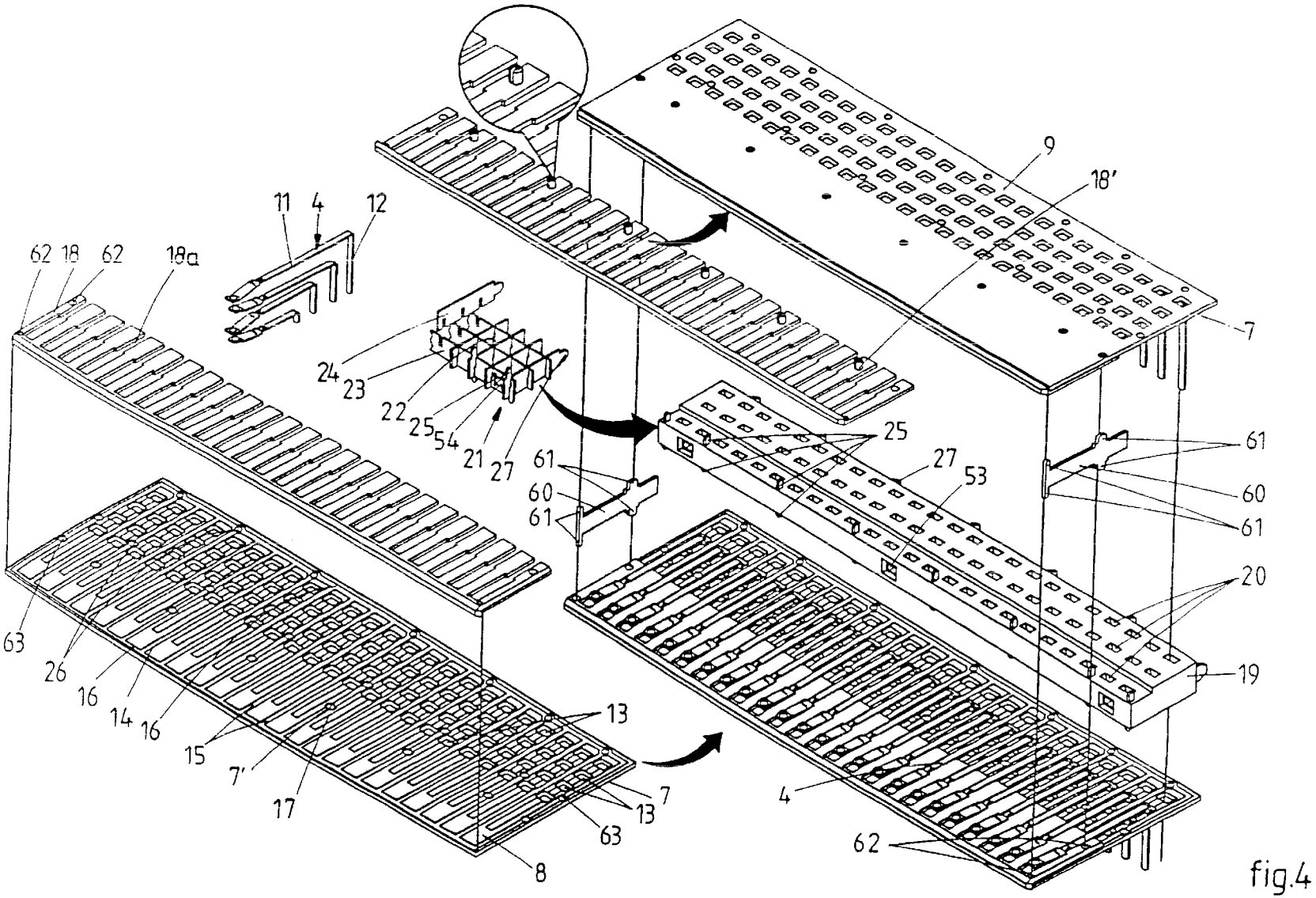
FIG. 4 is an exploded view of one of the modules of the connector of FIG. 1.

In the embodiment shown, the housing 3 comprises two modules 6 stacked in column direction, wherein each module 6 includes two housing parts 7 which in this case each comprise an elongated mainly rectangular flat printed circuit board (see FIGS. 3 and 4). Each printed circuit board 7 supports one row of the contact elements 4 on a first surface 8. The opposite second surface of the printed circuit board 7 is provided with a conductive ground plane 9 covering the complete surface of the printed circuit board.

The construction of the modules 6 and printed circuit boards 7 is shown in more detail in FIGS. 3 and 4. As shown, the printed circuit boards 7 of one module 6 are mounted with their first surfaces 8 directed towards each other to determine a receiving space 10 for receiving a housing part of a male connector to be mated with the female connector 1, as described hereinafter. The contact elements 4 are L-shaped with a first section 11 extending parallel to the printed circuit boards 7 and a second section 12 extending perpendicular to the printed circuit boards 7. Each printed circuit board 7 of a module 6 is provided with in this case four rows of holes 13, wherein successive rows of holes 13 receive the second sections 12 of successive rows of contact elements 4.

The first surface 8 of each printed circuit board 7 is provided with a pattern 14 of ground tracks connected to the ground plane 9 through via holes, for example. This pattern 14 comprises first tracks 15 at each side of the contact elements 4 supported on the first surface 8. The first tracks 15 are interconnected at both longitudinal edges of the printed circuit board 7 by second tracks 16. In this manner the ground track pattern 14 provides for a shielding between the contact elements 4. The first surface 8 of the printed circuit board 7 is further provided with contact tracks 17, wherein the first sections 11 of the contact elements 4 are attached to these contact tracks 17, for example by soldering.

At the front side each printed circuit board 7 is provided with a housing section 18 of insulating material. Each housing section 18 has a row of slots 18*a* receiving the front ends of the first sections 11 of the contact elements 4, which front ends operate as a spring as described in the above-mentioned copending applications. The housing sections are provided with a plurality of protruding pegs 18'. These pegs 18' are forced into holes 7' of the printed circuit board 7 to fix the housing section 18 on the same.

The two printed circuit boards 7 of one module 6 are interconnected through an intermediate housing section 19 of insulating material having in this case three rows of holes 20 aligned with the first three rows of holes 13 of the printed circuit boards 7, as seen from the backside. A metal frame 21 is moulded in the intermediate housing 19 providing an array of square channels 22 each enclosing a hole 20. The metal frame 21 is an assembly of mutually perpendicular metal strips 23, 24. A metal shielding plate 60 is provided at both longitudinal ends of one module 6. Each shielding plate 60 comprises projecting terminals 61 engaging in holes 62 of the housing section 18 and holes 63 of the printed circuit boards 7 so that a further mutual fixation of the printed circuit boards 7 is obtained. The terminals 61 connect the shielding plate 60 to the ground track pattern 14. The shielding plates 60 further provide more rigidity to the front part of the module 6.

As will be clear from FIGS. 2, 3 and 4, the second sections 12 of the contact elements 4 extend through the holes 20 of the intermediate housing sections 19 and thereby through the channels 22 of the metal frame 21. In this manner a complete shielding of the second sections 12 of the contact elements 4 is obtained in a very efficient manner.

Only the second sections of the most backwards row of contact elements 4 extend through a row of holes of the intermediate housing section 19 of the corresponding module 6, whereas the second sections 12 of both rows of contact elements of the upper module 6 extend through the rows of holes 20 of the intermediate housing section 19 of the previous module 6.

In FIG. 4 it can be seen that some of the strips 24 are provided with connection terminals 25 projecting out of the intermediate housing section 19 at the upper and lower sides thereof. These connection terminals 25 contact the first ground tracks 15 of the ground track pattern 14 and are received in holes 26 of the printed circuit boards 7. In this manner the metal frame 21 is interconnected to the ground plane 9 and ground track pattern 14. Further, some of the strips 24 are provided with connection terminals 27 projecting out of the intermediate housing section 19 at the backside thereof. These connection terminals 27 are received in slots 28 of the outer shielding plate 2 to interconnect the outer shielding plate 2, the metal frame 21 and ground plane 9 and ground track pattern 14.

It is noted that the ground planes 9 of the adjacent printed circuit boards 7 of two stacked modules are contacting each other thereby interconnecting the shieldings of the modules. Further, the outer shielding plate 2 will contact the ground plane 9 of the uppermost printed circuit board 7 of the housing 3. Finally, as shown in FIG. 2, a shielding plate 29 is mounted at the lower side of the housing and this shielding plate 29 contacts the ground plane 9 of the lower most printed circuit board 7 of the housing.

It will be understood, that a very efficient shielding of the contact elements 4 is obtained in the female connector 1 described. This efficient shielding is obtained without using any of the contact elements 4 as ground contact elements. Therefore, the signal density on the surface area occupied by the connector is relatively high. Moreover, the construction of the female connector with stackable modules 6, wherein the printed circuit boards 7 of the modules are identical, provides for a flexible design and low cost manufacturing, wherein the number of contact elements in one column can be varied as desired and depending on the intended use of the connector. It is noted that in case further modules are stacked on the two modules of the connector described, it is possible to use the same type of printed circuit boards for all modules or to use printed circuit boards with larger dimensions only in the further modules to be added.

Figure 5C:
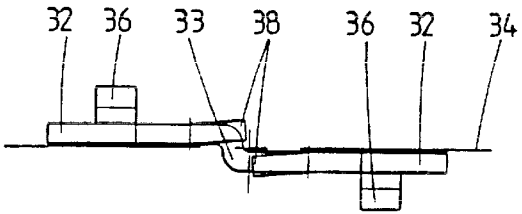
FIGS. 5A–5C show a top view, side view and front view, respectively, of the ground contact element of the connector according to FIG. 1.
Figure 5A:
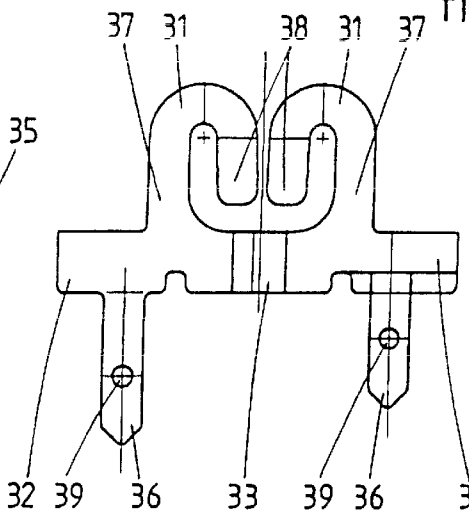
Figure 5B:
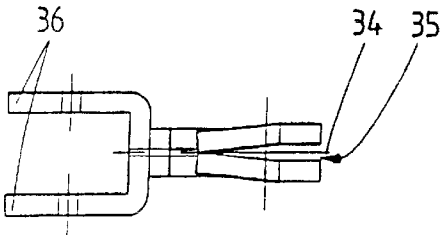

The female connector 1 shown in FIG. 1 is provided with three ground contact elements 30 which are shown in more detail in FIGS. 5A–5C. In the embodiment of the female connector 1 shown in FIG. 1, the ground contact elements 30 are straddle mounted on the front edge of the adjacent printed circuit boards 7 of the two stacked modules 6. The co-operation of these ground contact elements 30 with a shielding plate of the male connector will be described hereinafter.

Each ground contact element 30 comprises two contact beams 31 each having a base portion 32, wherein the contact beams 31 are cantilevered from their base portions in a longitudinal plane. Further the base portions 32 are interconnected by an intermediate section 33 enclosing an angle with the base portions such that the base portions 32 with their contact beams 31 are offset with respect to a central plane 34 extending parallel to the longitudinal planes of the base portions 32 and contact beams 31. The central plane 34 extends through a contact receiving gap 35 for receiving a shielding plate of the male connector as described hereinafter.

Each base portion 32 is provided with a connection leg 36 connected to the ground track pattern 14 on the first surfaces of the adjacent printed circuit boards 7. As shown in FIG. 5B, the connection legs 36 are offset with respect to the longitudinal plane of the corresponding base portion 32 and contact beam 31. As an alternative it is possible to have one of the connection legs at an offset with respect to the longitudinal plane only, for example to adapt the contact element 30 for straddle mounting on one printed circuit board 7 only. In that case, the ground contact element 30 interconnects the ground plane 9 and the ground track pattern 14. In the embodiment shown in FIG. 1, the ground contact elements 30 interconnect the ground track patterns 14 of the adjacent printed circuit boards 7.

In the embodiment of the contact element 30 shown, each contact beam is mainly U-shaped, wherein a first end 37 is connected to the base portion 32 and a second end 38 provides a distal end of the contact beam. In the embodiment shown, the distal ends 38 are skewed in opposite directions. However it is possible to have the distal ends 38 skewed in the same direction.

The connection legs 36 can be provided with opposing dimples 39 to allow initial clipping of the contact element 30 on the edge of the printed circuit board(s) 7 preceding the soldering operation to attach the contact element 30 to the printed circuit board.

Figure 8:
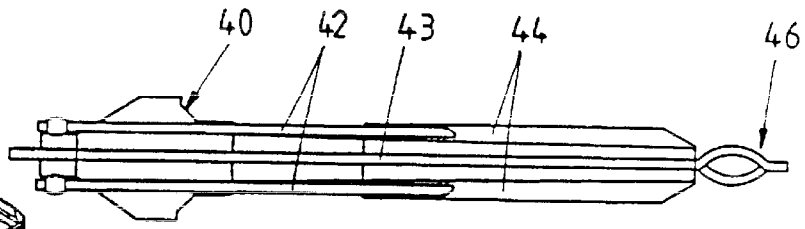
FIG. 8 is a schematical cross section of the housing part of FIG. 7.
Figure 7:
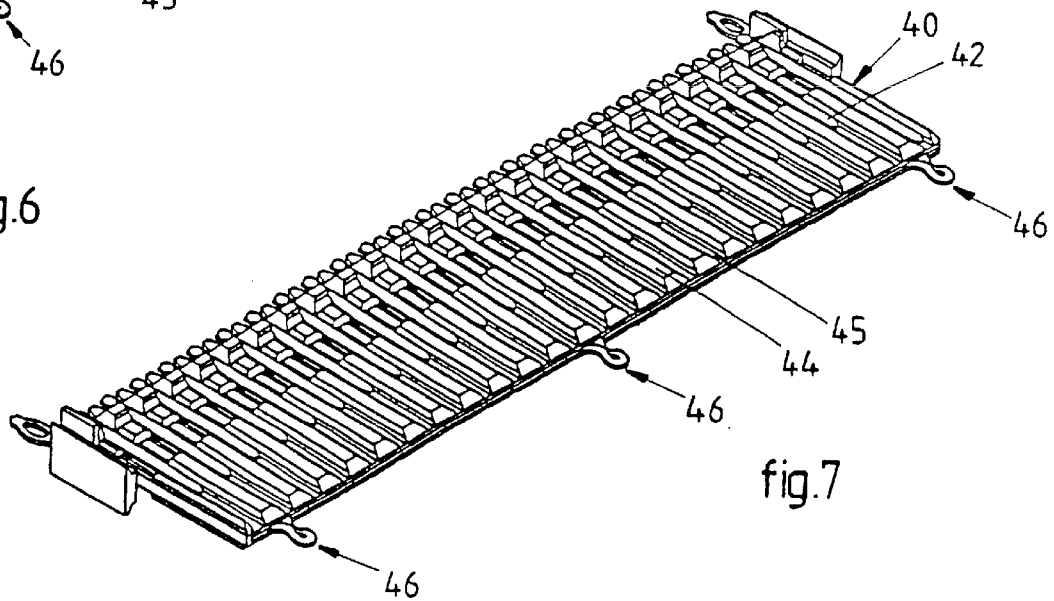
FIG. 7 shows a perspective view of the housing part of FIG. 6, wherein the contact elements are mounted in the housing part.
Figure 6:
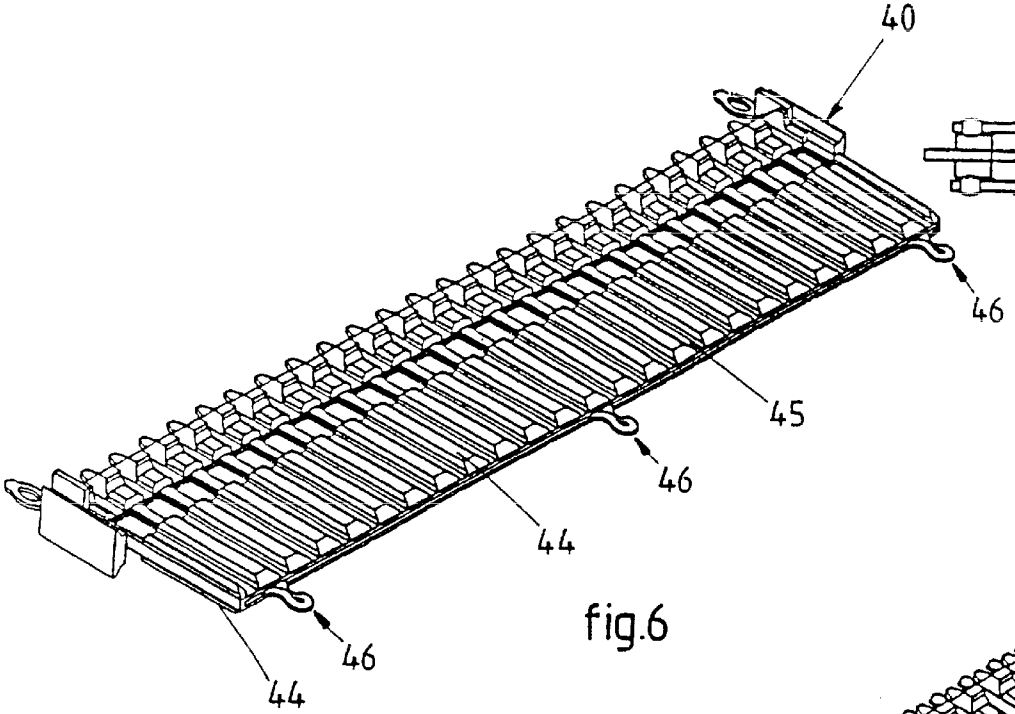
FIG. 6 shows a perspective view of a housing part of a male connector forming a connector assembly together with the female connector of FIG. 1.

FIGS. 6–8 show a housing part 40 of a male connector 41 shown in FIG. 10 together with the female connector 1 of FIG. 1. The housing part 40 and male connector 41 mainly correspond with the male connector disclosed in the above-mentioned co-pending patent applications to which reference is made for further details.

Figures 10A, 10B:
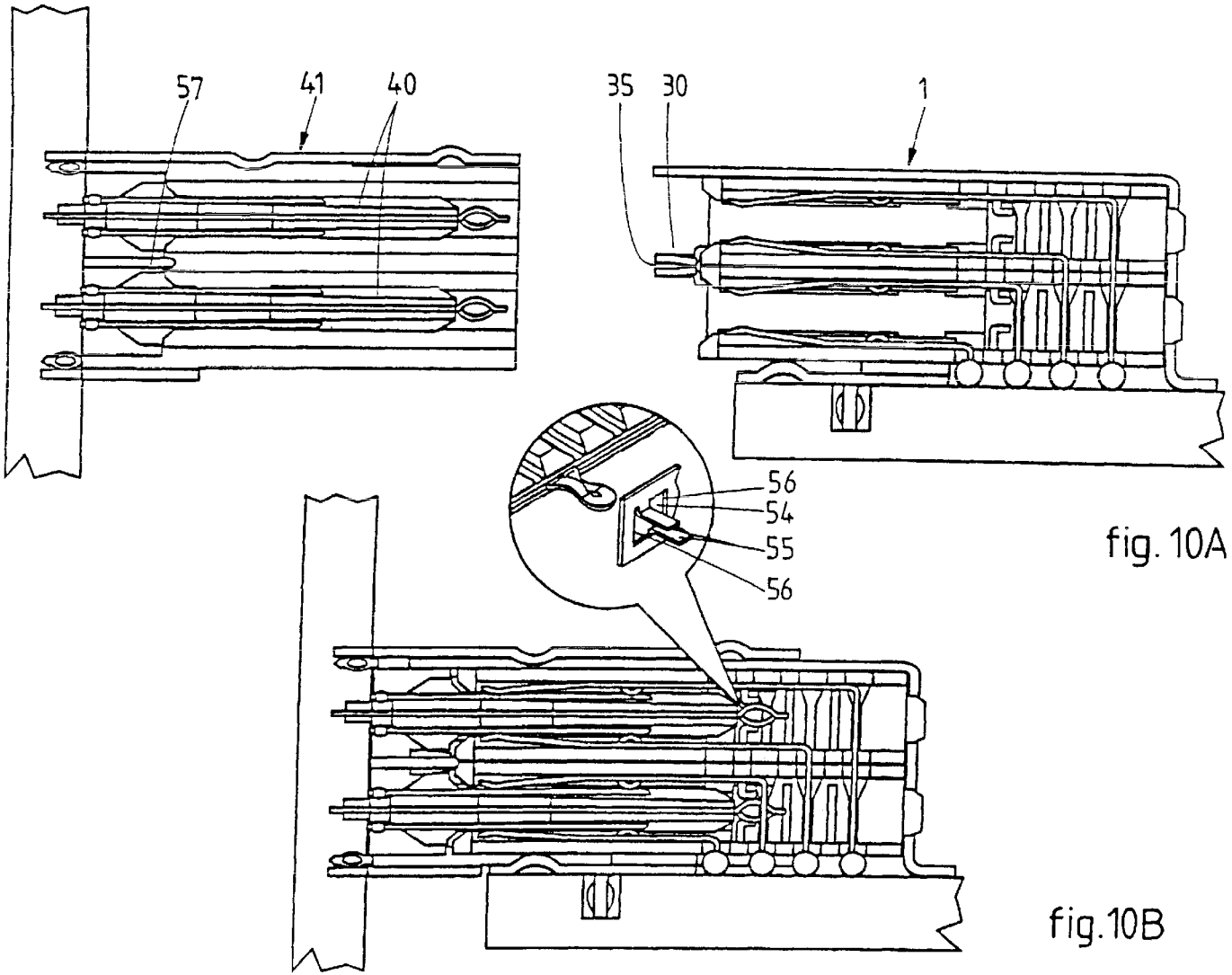
FIGS. 10A and 10B show the male and female connectors providing a connector assembly in the unmated and mated position, respectively.

The housing part 40 is adapted to be inserted into the receiving space 10 of a module 6 of the female connector 1 during mating of the male and female connectors 41, 1 (see FIG. 10B). The housing part 40 is provided with two rows of male contact elements 42, only one row of which can be seen in FIG. 7. The housing part 40 includes an elongated mainly rectangular flat metal plate 43 with an overmoulded layer 44 of insulating material at both sides. The construction of the housing part and the method for manufacturing the same are further described in a copending application which is incorporated by reference. Each insulating layer 44 has one row of slots 45 in which the contact elements 42 are mounted. Therefore, the metal plate 43 provides a shielding between the two rows of male contact elements 42.

Figure 9A:
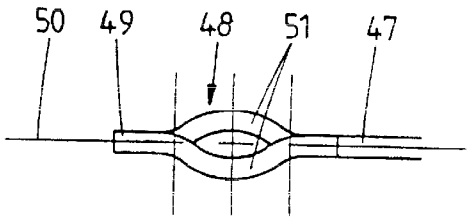
FIGS. 9A and 9B show a top view and a side view, respectively, of the ground contact element of the housing part of FIG. 6.
Figure 9B:
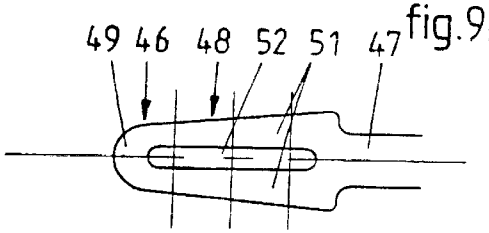

In the embodiment shown, the metal plate 43 is provided with three ground contact elements 46 at its front edge. These ground contact elements 46 are shown in detail in FIGS. 9A and 9B. Each male ground contact element 46 comprises a flat connection end 47 joining the metal plate 43 and a contact portion 48 for contacting a ground contact socket of the female connector 1, as will be described later. The contact portion 48 is provided with a rounded distal end 49. The flat connection end 47 and the distal end 49 determine a central plane 50 of the contact element 46, which central plane coincides with the central plane of the 45 metal plate 43 in the embodiment shown. As an alternative the central plane 50 can be perpendicular to the central plane of the metal plate 43 or can enclose an angle with this central plane.

The contact portion 48 is provided with two contact beams 51 interconnected at both ends by the flat connection end 47 and the distal end 49, respectively. The contact beams 51 are separated by a slot 52. Further, the contact beams 51 are offset in opposite directions in an arcuate shape with respect to the central plane 50 of the contact 25 element 46. The width of the contact portion 48 increases from the distal insertion end 49 towards the connection end 47, wherein in the embodiment shown the slot 52 has a constant width, whereas the contact beams 51 each have a width increasing from the distal end 49. In this manner the contact beams 51 provides contact springs having a spring action into mutual perpendicular directions.

The ground contact elements 46 are adapted to cooperate with ground contact sockets 53 provided in the female connector 1. As can be seen in FIGS. 2, 4 and 10, the ground contact sockets 53 are formed in the intermediate housing section 19, wherein mainly square holes 54 are formed in the strip 23 located at the front side of the intermediate housing section 19. Each ground contact socket 53 is provided with first contact surfaces 55 provided by lips formed out of the strip 23. The first contact surfaces 55 co-operate with the arcuate surface of the contact beams 51. Further the ground contact sockets 53 are provided with second contact surfaces 56 formed by edges of the holes 54 in the strip 23, which second contact surfaces co-operate with the side edges of the contact beams 51. As shown in FIG. 10B, the arcuate surfaces and the side edges of the contact beams 51 are forced against the first and second surfaces 55, 56 of the ground contacts sockets 53 when the female and male connectors 1, 41 are mated. In this manner a reliable interconnection of the shielding of the female and male connectors 1, 41 is guaranteed.

A further interconnection of the shieldings is provided by means of the ground contact elements 30 of the female connector 1. As shown in FIG. 10A, the male connector 41 comprises two housing parts 40 separated by an inner shielding plate 57. When the female and male connectors 1, 41 are mated as shown FIG. 10, the inner shielding plate 57 is received in the gap 35 of the ground contact elements 30, wherein the U-shaped contact beams 31 with their skewed distal ends 38 provide a reliable connection.

The invention is not restricted to the above described embodiments which can be varied in a number of ways within the scope of the attached claims.

What is claimed is:

1. Connector assembly, comprising female and male connectors, (1; 41) each connector comprising a housing (3; 40) and a plurality of contact elements (4; 42) mounted in the housing, said contact elements being arranged in rows and columns, wherein the housing is provided with rows of slots (18*a*; 45) receiving first sections (11) of the contact elements, the housing (3) of the female connector (1) having at least one receiving space (10) for receiving a part (40) of the housing of the male connector, (41) wherein a row of contact elements is located at both sides of the receiving space of the female connector housing and a row of contact elements is located at both sides of the part of the male connector housing to be inserted into the receiving space, the contact elements of the male connector contacting the contact elements of the female connector when the male and female connectors are mated, characterized in that the female connector housing (3) comprises a housing part (7) for each row of contact elements, (4) each housing part including an elongated mainly rectangular flat printed circuit board (7) supporting the corresponding row of contact elements on a first surface (8) and having a conductive ground plane (9) on an opposite second surface, wherein a housing section (18) of insulating material is mounted on said first surface, said housing section having one of said rows of slots, (18*a*) wherein the female connector housing comprises at least one module, (16) each module having two interconnected printed circuit boards (7) having their first surfaces (8) directed towards each other and determining one receiving space, (10) and in that the male connector housing comprises at least one housing part (40) adapted to be inserted into the receiving space (10) of a module (6) during mating of the male and female connectors and provided with two rows of contact elements, (42) each housing part including an elongated mainly rectangular flat metal plate (43) with an overmoulded layer (44) of insulating material at both sides, each insulating layer having one of said rows of slots (45) with contact elements (42).

2. Connector assembly according to claim 1, wherein at least one of the female connector housing parts(7) is provided with at least one ground contact element (30) connected to the ground plane (9) and mounted at a front edge of the printed circuit board, (7) said ground contact element having two contact beams, (31) wherein the male connector (41) is provided with a shielding plate (57) extending parallel to the male connector housing part, wherein with mated male and female connectors, the shielding plate is received between the contact beams (31) of the ground contact element (30).

3. Connector assembly according to claim 2, wherein the contact beams (31) of the ground contact element (30) each have a base portion, (32) the contact beams being cantilevered from their base portions in a longitudinal plane, the distal ends of the contact beams determining a contact receiving gap (35) for the shielding plate (57) of the male connector, (41) wherein the base portions (32) are interconnected by an intermediate section (33) enclosing an angle with the base portions such that the base portions with their contact beams are offset with respect to a central plane (34) extending parallel to the longitudinal plane of each base portion and corresponding contact beam, said central plane determining the contact receiving gap, (36) wherein each base portion (32) is provided with a connection leg (36) connected to a surface of a printed circuit board (7) of the female connector.

4. Connector assembly according to claim 3, wherein the first surface (8) of each printed circuit board (7) is provided with a pattern (14) of ground tracks comprising first tracks (15) at each side of the contact elements (4) supported on said first surface, wherein the pattern (14) of ground tracks of two adjacent printed circuit boards (7) or the pattern of ground tracks and the ground plane (9) of a printed circuit board (7) are interconnected through the ground contact element (30).

5. Connector assembly according to claim 2, wherein each contact beam (31) of the ground contact element (30) is mainly U-shaped, a first end (37) being connected to the base portion (32) and a second end (38) providing the distal end, wherein the distal ends are skewed with respect to the first ends, wherein at least one of the connection legs (36) is offset with respect to the longitudinal plane of the corresponding base portion and contact beam, so that the ground contact element is straddle mounted on the edge of one printed circuit board (7) or two adjacent printed circuit boards (7).

6. Connector assembly according to claim 1, wherein the female connector (1) is provided with at least one ground contact socket (53) connected to the ground planes (9) of the printed circuit boards, wherein the male connector (41) is provided with at least one ground contact element (46) connected to the metal plate (43) of a male connector housing part (40) and mounted at a front edge of said housing part, wherein with mated male and female connectors, the male ground contact element (46) is received in the ground contact socket (53).

7. Connector assembly according to claim 6, wherein the male ground contact element (46) comprises a flat connection end (47) joining the metal plate (43) and a contact portion(48) for contacting the ground contact socket (53) and having a distal insertion end, (49) the flat connection end and the distal insertion end determining a central plane (50) of the contact element, wherein said contact portion (48) is provided with two contact beams (51) interconnected at both ends and separated by a slot, (52) wherein the contact beams are offset in opposite directions with respect to the central plane (50) of the contact element, said contact beams (51) being forced against first contact surfaces (55) of the ground contact socket (53) then the male and female connectors are mated.

8. Connector assembly according to claim 7, wherein the contact portion (48) of the male ground contact element (46) has a width increasing from the distal insertion end to force side edges of the contact beams (51) against second contact surfaces (56) of the ground contact socket (53) when the male and female connectors are mated, the first and second contact surfaces (55,56) extending mutually perpendicular.

9. Connector assembly according to claim 8, wherein the contact elements (4) of the female connector (1) are L-shaped with said first section (11) extending parallel to the printed circuit boards (7) and a second section (12) extending perpendicular to the printed circuit boards, wherein each printed circuit board (7) of a module (6) is provided with a plurality of holes (13) arranged in successive parallel rows, wherein successive rows of holes receive the second sections of successive rows of contact elements, wherein the printed circuit boards of each module are interconnected through an intermediate housing section (19) of insulating material having a plurality of rows of holes (20) aligned with rows of holes (13) of the printed circuit boards (7) of the module, (16) wherein the second sections (12) of at least one row of contact elements (4) the corresponding module extend through the holes (20) of the intermediate housing section, (19) and wherein, if the housing comprises at least two modules (6) stacked in column direction, the second sections of the rows of contact elements of an adjacent module extend through the holes of the intermediate housing section of the previous section, a metal frame (21) being moulded in in the intermediate housing section, (19) said metal frame being connected to the ground planes (9) and enclosing each second section (12) of a contact element (4) extending through this housing section, wherein the intermediate housing section (19) and the metal frame (21) provide said at least one ground contact socket, (53) the metal frame having the first and second contact surface (55,56).

10. Connector assembly according to claim 9, wherein the metal frame (21) comprises a plurality of connection terminals (25) projecting out of the intermediate housing section (19) and being connected to the ground planes (9) of the printed circuit boards (7) of the corresponding module, (6) wherein the female connector (1) is provided with an outer shielding plate (2) enclosing upper and back sides of the housing, (3) wherein the metal frame (21) further comprises connection terminals (27) projecting out of the back side of the housing and contacting the outer shielding plate (2).

* * * * *